US005329981A

United States Patent [19]

Ito et al.

[11] Patent Number: 5,329,981

[45] Date of Patent: Jul. 19, 1994

[54] METHOD OF PRODUCING A METAL MOLD

[75] Inventors: Masahito Ito; Miyuki Koujiya; Hiroshi Sarai; Seiya Nakao; Takao Nomura; Satoru Kitou; Fuminori Matsuda; Susumu Yamada; Kesato Kuroiwa; Hiroshi Mihara, all of Toyota, Japan

[73] Assignee: Toyota Jidosha Kabushiki Kaisha, Toyota, Japan

[21] Appl. No.: 133,282

[22] Filed: Oct. 7, 1993

Related U.S. Application Data

[63] Continuation of Ser. No. 715,856, Jun. 17, 1991, abandoned, which is a continuation of Ser. No. 433,373, Nov. 9, 1989, abandoned.

[30] Foreign Application Priority Data

May 10, 1989 [JP] Japan ..... 1-116554
May 22, 1989 [JP] Japan ..... 1-128055

[51] Int. Cl.[5] ..... B22D 18/00; B22D 18/06

[52] U.S. Cl. ..... 164/7.2; 164/63; 164/65; 164/160.2

[58] Field of Search ..... 164/7.1, 7.2, 61, 62, 164/63, 65, 137, 160.1, 160.2, 253, 254, 255

[56] References Cited

U.S. PATENT DOCUMENTS

| | | | |
|---|---|---|---|
| 3,548,050 | 4/1967 | Mozer | 164/91 |
| 3,789,907 | 2/1974 | Nakata | 164/7.2 |
| 4,043,376 | 8/1977 | Kasai | 164/7.2 |
| 4,217,946 | 8/1980 | Murahashi | 164/7.2 |

FOREIGN PATENT DOCUMENTS

| | | | |
|---|---|---|---|
| 48-7576 | 3/1973 | Japan . | |
| 51-55733 | 5/1976 | Japan . | |
| 51-018219 | 6/1976 | Japan | 164/7.2 |
| 53-010529 | 4/1978 | Japan | 164/7.2 |
| 53-15969 | 5/1978 | Japan . | |
| 53-034562 | 9/1978 | Japan | 164/7.2 |
| 55-6014 | 2/1980 | Japan . | |
| 62-81226 | 4/1987 | Japan . | |
| 62-105771 | 11/1988 | Japan . | |
| 62-175641 | 1/1989 | Japan . | |
| 62-251259 | 4/1989 | Japan . | |

OTHER PUBLICATIONS

"Metal Press" Nov. 1976, pp. 16 and 17.

Japanese Laid-Open Technical Report No. 89-6998 (vol. 14-24), May 20, 1989.

*Primary Examiner*—P. Austin Bradley
*Assistant Examiner*—Rex E. Pelto
*Attorney, Agent, or Firm*—Finnegan, Henderson, Farabow, Garrett & Dunner

[57] ABSTRACT

A method of producing a metal mold is disclosed. A heat resistant sheet is forcedly brought into close contact with a product configuration surface of a matrix such as a wooden pattern, a resin model, or the like by making use of negative pressure. The matrix is brought into contact with a melt of a low melting-point alloy while that state of close contact is being maintained and the melt is allowed to cool as it is, thereby casting one part of the mold which makes up a pair. The matrix is then removed, and by using the one part of the mold thus cast as a new matrix, this new matrix is brought into contact with the melt of a low melting-point alloy via the heat resistant rubber sheet and is allowed to cool as it is, thereby casting a counterpart of the mold that makes up the pair.

29 Claims, 7 Drawing Sheets

METHOD OF PRODUCING A METAL MOLD

This application is a continuation, of application Ser. No. 07/715,856, filed Jun. 17, 1991 now abandoned which was a continuation of application Ser. No. 07/433,373, filed Nov. 9, 1989, now abandoned.

BACKGROUND OF THE INVENTION

1. Field of the Invention

The present invention relates to a method of producing a metal mold easily by using a low melting-point alloy.

2. Description of the Related Art

Conventionally, to produce a metal mold easily, a method has been generally adopted in which a gypsum pattern and a sand mold are fabricated consecutively from a matrix by means of transfer, and a low melting-point alloy (mold material) such as a zinc alloy is cast into the sand mold ("Metal Press" November 1976, pp. 16 and 17). According to this method, however, there is a problem that transfer processes are numerous and a long period is required for fabrication of the mold, resulting in a high cost burden.

Accordingly, a dual forming method has been proposed in which a press apparatus and a melting apparatus are formed integrally, and a forming model (matrix) having a product thickness of such as a sheet metal model and provided with bores is immersed in a melt of a low melting-point alloy in a melting tank and is allowed to solidify as it is, thereby simultaneously obtaining a punch and a die (Japanese Patent Publication No. 7576/1973). As a modification of the dual forming method, a method is also known in which, by using a forming model having no bores, an outer surface of the forming model is brought into contact with a melt of a low melting-point alloy, and an alloy of a type different from the aforementioned alloy is poured into its inner surface and is allowed to solidify as it is, thereby simultaneously obtaining a punch and a die of different types of alloy (Japanese Patent Publication No. 15969/1978, Japanese Patent Laid-Open No. 55733/1976, etc.). These methods have already been established and put to practical use. According to these methods, it is possible to obtain a punch and a die simultaneously via a forming model. The efficiency with which metal molds are produced can be improved substantially over the widely practiced method using the aforementioned sand mold.

However, with these methods using forming models, it is necessary to fabricate the forming models with high accuracy in order to ensure a clearance between the punch and the die. Hence, there have been drawbacks that the fabrication of the forming models is very troublesome, and that it is impossible to readily cope with design changes.

Meanwhile, Japanese Patent Publication No. 6014/1980 discloses a method wherein a heat resistant resin sheet is attached to a matrix such as a wooden pattern, and this assembly is accommodated in a casting frame, into which a melt of a low melting-point alloy is subsequently cast to produce a female die. The resin sheet is transferred onto and attached to the female die by the heat generated at that time, the casting frame is inverted, and the melt of a low melting-point alloy is poured into the female die, thereby casting a male die. According to this method, since it is possible to ensure a die clearance by means of the resin sheet, the aforementioned forming model becomes unnecessary, so that various problems encountered in the use of the forming models can be overcome.

However, since the aforementioned heat resistant resin sheet is an adhesive sheet which thermosets afterwards, if an attempt is made to bring the sheet into close contact with the product configuration surface of the matrix, a local elongation unavoidably occurs, and the occurrence of wrinkles and the trapping of air cannot be avoided. For this reason, so-called patching work must be performed by dividing the sheet into a multiplicity of small pieces. Consequently, much labor and skill are required in the same way as in the attachment of sheet wax, with the result that a decline in the work efficiency becomes unavoidable.

SUMMARY OF THE INVENTION

Accordingly, an object of the present invention is to provide a method of producing a metal die which is capable of obtaining a metal model with ease and high accuracy without using a forming model, thereby overcoming the above-described drawbacks of the conventional art.

To this end, in accordance with the present invention, there is provided a method of producing a metal mold, comprising the steps of: causing a heat resistant and elastic sheet to be forcedly brought into close contact with a product configuration surface of a matrix such as a wooden pattern, a resin model, or the like, by making use of negative pressure; bringing the matrix into contact with a melt of a low melting-point alloy while maintaining that state of close contact; cooling the melt as it is, thereby casting one part of the mold which makes up a pair; removing the matrix; bringing the one part of the mold into contact with the melt of a low melting-point alloy while maintaining the state of close contact between the heat resistant rubber sheet and the one part of the mold cast; and allowing the melt to cool as it is, thereby casting a counterpart of the mold that makes up the pair.

In the present invention, the type of the aforementioned low melting-point alloy is not particularly restricted if its solidification shrinkage rate is small, for instance, it is possible to select the low melting-point in the range of 50°–250° C. from a Bi-Sn alloy, Sn-Pb alloy, Bi-Sn-Pb alloy, Bi-Sn-Pb-Cd alloy, and Bi-Sn-Pb-Sb alloy.

In addition, in the present invention, the type of the aforementioned heat resistant rubber sheet is not particularly restricted insofar as it is capable of withstanding the melting temperature of the low melting-point alloy and maintaining resiliency. For instance, the heat resistant rubber sheet may be formed of silicone rubber, fluororubber, ethylene propylene rubber, acrylic rubber, chloroprene rubber, butadiene rubber, or the like. In cases where an alloy having a relatively high melting point is used as the low melting-point alloy, such as a Bi-Sn alloy or Sn-Pb alloy, it is preferable to use silicone rubber or fluororubber which excels in heat resistance. In addition, the thickness of the rubber sheet is selected to be capable of securing a clearance corresponding to a product thickness between the same and a die component that makes up a pair.

In the present invention, as described above, the heat resistant rubber sheet is brought into close contact with a matrix by making use of negative pressure. However, since there is the possibility of the thickness of the rubber sheet when in close contact becoming nonuniform due to variations in the elongation of the rubber sheet caused by friction, preferably a substance which has a low coefficient of friction and is not modified at the melting temperature of the low melting-point alloy is applied in advance to the surface of the rubber sheet and/or the matrix which are adhered with each other. Such a substance may be selected from, for instance, molybdenum disulfide ($MoS_2$), boron nitride (BN), and graphite (C).

In addition, in the present invention, after one part of the mold that makes up a pair is cast, the matrix is removed, and the melt of a low melting-point alloy is brought into contact with the one part of the mold via the heat resistant rubber sheet, thereby to cast the counterpart of the mold. The rubber sheet is thermally bonded to the one part of the mold by means of the heat of the melt at the time of the initial casting. Accordingly, it is unnecessary to take into special consideration the close contact of the rubber sheet during the subsequent casting; however, where there is a large unevenness in the mold surface, there is the possibility of the rubber sheet partially floating up. Hence it is preferred that the close contact of the rubber sheet is supported by making use of negative pressure, or that an adhesive constituted by a thermosetting resin is applied in advance to the surface of the rubber sheet to be brought into contact with the melt, thereby allowing the rubber sheet to be bonded to the one part of the mold upon completion of solidification by making use of the setting of the adhesive.

In casting, two casting frames are used, and are assembled as a unit with a matrix accommodated in one of them. At this time, the heat resistant rubber sheet is interposed between the two casting frames, and is clamped therebetween. The matrix may preferably be provided with a plurality of air vent holes, and if negative pressure is supplied through these holes via the casting frame, the rubber sheet can be brought into close contact with the matrix positively. The two casting frames may be joined vertically or horizontally, and in each case the one casting frame opposed to the other casting frame with the matrix accommodated therein provides a casting space. The melt of the low melting-point alloy is supplied to this casting space and is brought into contact with the matrix. A method of supplying the melt into this casting space is arbitrary and, for instance, the melt may be poured simply from above, or is pushed upward from below in the manner of low-pressure casting. When the two casting frames are joined vertically, since a casting space can be formed in the lower casting frame, a heater may be incorporated in this lower casting frame so as to hold in advance the melt in the casting space.

Further, when two casting frames are joined vertically, in order to make the air venting easier, the casting may be carried out in such a manner that the casting in the upper casting frame is carried out in advance by accommodating the matrix in the lower casting frame, subsequently the casting frame is turned upside down and the casting in the casting frame located on the top and from which the matrix is removed.

The type of the metal mold used in the present invention is not particularly restricted, but may preferably be applied to a press die for a sheet metal processing and a mold for resin molding. In the case of the press die, if one part of the mold that makes up a pair is set as a die, and a counterpart thereof as a punch, as a matrix it suffices to prepare one for the die alone, and the fabrication of the matrix can be effected readily. In addition, the aforementioned matrix may be of a split type. In cases where a split type matrix is used, if the entire matrix is first accommodated in a casting frame to cast the counterpart die, the split components of the matrix are then removed consecutively or together, and casting is effected consecutively by making use of the evacuated space. Thus, it is possible to obtain a press die having, for instance, a die, a punch, and a blank holder.

According to the method of producing a metal mold of the present invention, it is possible to produce a metal mold easily by adhering a heat resistant rubber sheet to a matrix or one casting frame and also enables design changes to be made easily. Further, since it is possible to adhere the heat resistant rubber sheet having an excellent property of expansion and contraction to the surface of a product configuration consisting of the matrix evenly and rapidly by making use of the negative pressure, not only the productivity but also the precision of the product can be increased. In addition, the rubber sheet having heat resistance can be used repeatedly to attain a cost reduction through saving articles of consumption.

DESCRIPTION OF THE PREFERRED EMBODIMENTS

Referring now to the accompanying drawings, a description will be given of the preferred embodiments of the invention.

Figure 1:
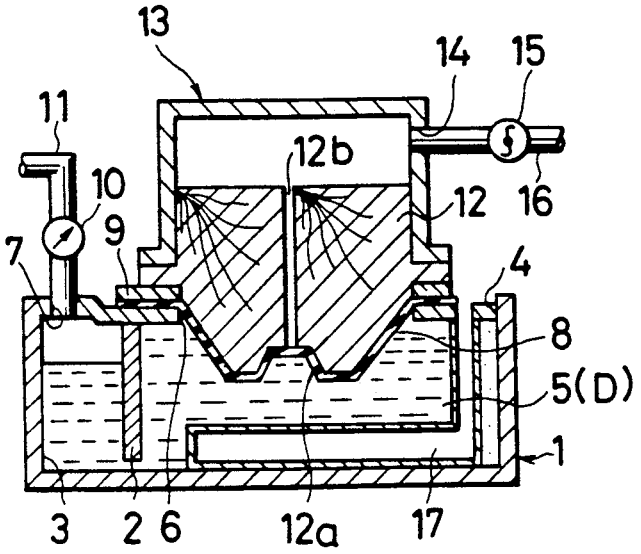
FIGS. 1 and 2 are cross-sectional views of a first embodiment of the present invention, illustrated in the order of steps.
Figure 2:
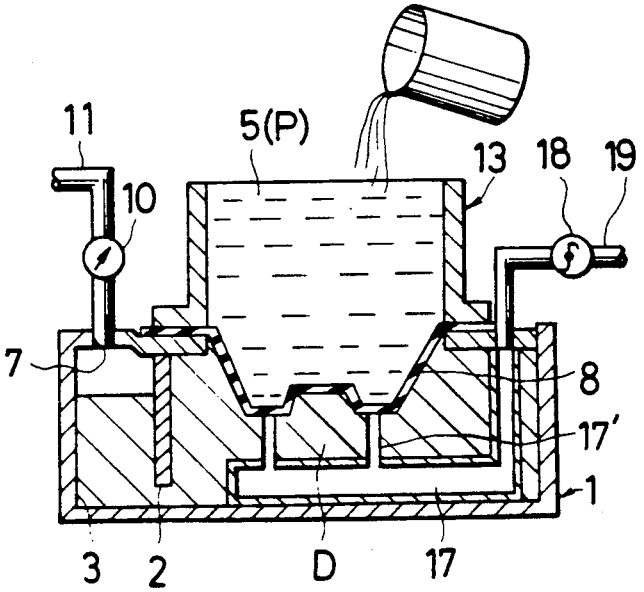

FIGS. 1 and 2 illustrate a first embodiment of the present invention. The first embodiment mainly comprises a first step (see FIG. 1) for casting a die D and a second step (see FIG. 2) for casting a punch P. In FIGS. 1 and 2, a die casting frame 1 communicates with a reservoir tank 3 via a partition plate 2. The die casting frame 1 and the reservoir tank 3 are covered with a cover plate 4 so as to maintain a hermetically closed state. A melt 5 of a low melting-point alloy is held in the interiors thereof. The cover plate 4 is provided with a large-diameter opening 6 in correspondence with the die casting frame 1 and a small-diameter opening 7 in correspondence with the reservoir tank 3. A heat resistant rubber sheet 8 formed of, for instance, silicone rubber or fluororubber is provided on the cover plate 4 in such a manner as to cover the opening 6 and is pressed by an outer plate 9. In addition, a pipe 11 having a pressure gauge 10 midway thereof is connected to the opening 7 on the reservoir tank 3 side, compressed air being supplied to the pipe 11.

Meanwhile, a matrix 12, which comprises a wooden pattern, resin model or the like, and a punch casting frame 13 for accommodating the matrix 12, are prepared. The matrix 12 and the punch casting frame 13 are mounted integrally on the outer plate 9 and are detachably fixed to the die casting frame 1. The matrix 12 has an air vent hole **12*b* which is open in its product configuration surface 12*a* and a rear surface thereof. The arrangement is such that, in the aforementioned fixed state, the product configuration surface 12*a* faces the interior of the die casting tank 1 via the rubber sheet 8. In addition, the punch casting frame 13 has a hole 14 in a side wall on its bottom side, and a pipe 16 having a vacuum pump 15 midway thereof is connected to the hole 14. An air tank 17, one end of which is closed, is provided on the bottom of the die casting frame 1. The other end of the air tank 17 is connected to the cover plate 4 so as to communicate with the outside, a pipe 19 having a vacuum pump 18 midway thereof being connected to said other end (see FIG. 2**).

In the first step, the melt 5 of the low melting-point alloy is held in advance in the die casting frame 1, or the melt 5 of the low melting-point alloy melted separately is supplied to the die casting frame 1. First, the rubber sheet 8 is placed on the cover plate 4, and is secured by the outer plate 9. At this time, the rubber sheet 8 is stretched with appropriate tension. Subsequently, the matrix 12, together with the punch casting frame 13, is placed on and fixed to the outer plate 9. By means of this fixing, the product configuration surface **12*a* of the matrix 12 projects substantially into the die casting frame 1 while expanding the rubber sheet 8. In this state, the vacuum pump 15 provided midway in the pipe 16 is actuated to introduce negative pressure into the punch casting frame 13. This negative pressure is supplied into the gap between the matrix 12 and the rubber sheet 8 via the air vent hole 12*b*, so that the rubber sheet 8 is brought into close contact with the product configuration surface 12*a* of the matrix 12. At this time, by virtue of its resiliency, the rubber sheet 8 stretches and shrinks in the direction in which its thickness becomes uniform, and the rubber sheet 8 becomes attached to the product configuration surface 12*a***, thereby securing a clearance necessary for a press.

Subsequently, compressed air is supplied to the interior of the reservoir tank 3 so as to push up the melt 5 of the low melting-point alloy to the upper end of the die casting frame 1. As a result, the product configuration surface **12*a* of the matrix 12 is immersed in the melt 5 of the low melting-point alloy via the rubber sheet 8, and the die casting frame 1 is then cooled while this immersed state is being maintained. Then, the melt 5 of the low melting-point alloy solidifies, with the result that the die D (see FIG. 2) to which the product configuration surface 12*a* of the matrix 12** is transferred, is obtained.

After the casting of the die D, a second step for casting the punch P is commenced. At the time of commencing this second step, the matrix 12 is removed after removing the punch casting frame 13, and the rubber sheet 8 is also removed. Subsequently, air vent holes 17' are bored in the die D in such a manner as to extend vertically therethrough and communicate with the air tank 17, as shown in FIG. 2. The rubber sheet 8 is then placed again on the die casting frame 1, the punch casting frame 13 with its bottom removed is set thereon, and the vacuum pump 18 provided midway in the pipe 19 is actuated to introduce negative pressure into the interior of the die casting frame 1. This negative pressure is supplied into the gap between the die D and the rubber sheet 8 via the air vent holes 17', causing the rubber sheet 8 to be brought into close contact with the punch-receiving surface of the die D. Subsequently, the punch casting frame 13 with its bottom removed is set on the die casting frame 1, and if the melt 5 of the low melting-point alloy is poured into the punch casting frame 13 in the same manner as described above and is allowed to solidify, the punch P can be obtained.

Hence, in the above-described steps, since the rubber sheet 8 is interposed between the punch P and the die D, a predetermined mold clearance can be secured between the punch P and the die D, making it possible to use these components as they are, as a press die. When used as a die press, the die casting frame 1 and the punch casting frame 13 are mounted on a press so as to be employed as holding frames for the die D and the punch P as they are, which simplifies the setting of the die D and the punch P on the press. Since in the first embodiment, in particular, the punch casting frame 13 also serves as a negative pressure chamber, it is possible to attain a reduction in equipment investment.

In the above-described first embodiment, at the time of casting the punch P, the rubber sheet 8 is brought into close contact with the die D by the use of negative pressure. However, since this rubber sheet 8 is slightly heat bonded to the die D by the heat of the melt 5, and since its state of close contact is maintained by the action of the external pressure (atmospheric pressure) unless air enters the gap between the rubber sheet 8 and the die D, it is possible to omit the use of negative pressure. In this case, the operation of inserting the air tank 17 and the operation of providing the die D with the air vent holes 17' can be dispensed with.

Figure 3:
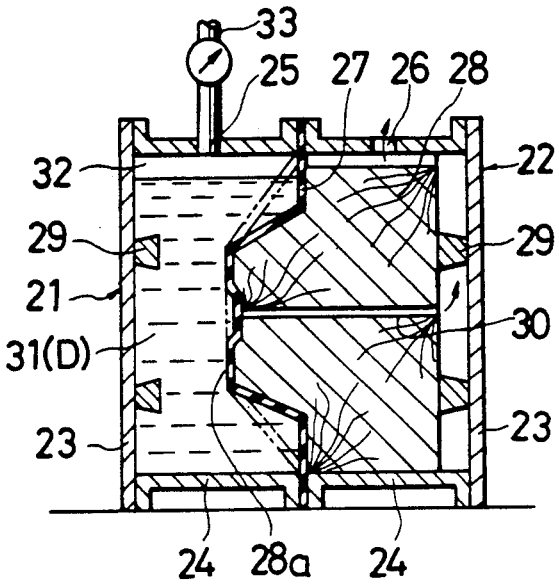
FIGS. 3 and 4 are cross-sectional views of a second embodiment of the present invention, illustrated in the order of steps.
Figure 4:
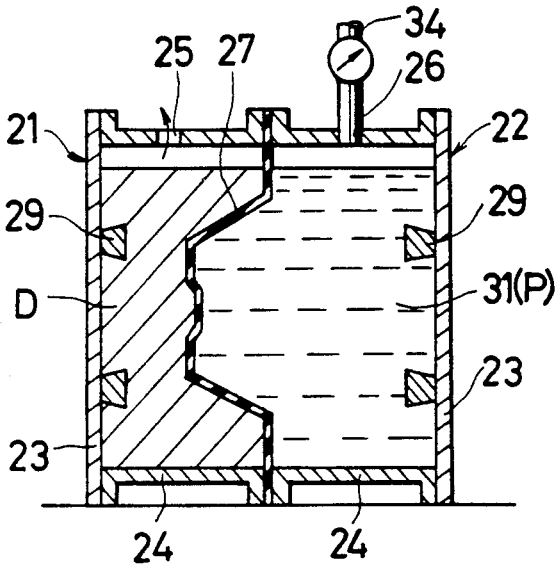

FIGS. 3 and 4 illustrate a second embodiment of the present invention which mainly comprises a first step (see FIG. 3) for casting the die D and a second step (see FIG. 4) for casting the punch P in the same manner as the first embodiment. In FIGS. 3 and 4, a die casting frame 21 and a punch casting frame 22 are respectively composed of a base plate 23 and side plates 24. The upper side plates 24 are provided with pouring ports 25, 26, respectively, and the die casting frame 21 and the punch casting frame 22 are formed integrally and are disposed on the left and the right with the pouring ports 25, 26 facing upward. A casting space inside the integrally formed die casting frame 21 and the punch casting frame 22 is divided into two by a heat resistant rubber sheet 27 formed of, for instance, silicone rubber or fluororubber. In the first step, a matrix 28 consisting of a wooden pattern, a resin model or the like is prepared, and the matrix 28 is accommodated in the punch casting frame 22 in such a manner that a product configuration surface **28*a* thereof is set vertically. A plurality of pegs 29 are provided on an inner surface of the base plate 27 of each casting frame 21, 22 in such a manner as to project therefrom, the matrix 28 being accommodated with its rear surface abutting against the pegs 29. An air vent hole 30 communicating with the product configuration surface 28*a* and the rear surface of the matrix 28 is provided in the matrix 28. The base plate 23 and the side plates 24 which comprise the casting frame 21, 22** are arranged to be capable of being disassembled.

A detailed description will be given hereinunder of the second embodiment in the order of steps.

First, in a state in which the die casting frame 21 and the punch casting frame 22 are separated from each other, the matrix 28 is accommodated in the punch casting frame 22, and the two casting frames 21, 22 are assembled as a unit with the rubber sheet 27 clamped therebetween, as shown in FIG. 3. At this time, the rubber sheet 27 is stretched with appropriate tension so that wrinkles will not be produced. Then, the pouring port 26 on the punch casting frame 22 side is connected to a vacuum pump (not shown), thereby causing the rubber sheet 27 to be forcedly brought into contact with the matrix 28. By virtue of its excellent configuration following characteristics, the rubber sheet 27 stretches or shrinks in the direction in which its thickness becomes uniform, and the rubber sheet 27 becomes attached to the product configuration surface 28*a* of the matrix 28 with a thickness corresponding to the thickness of a press product.

Then, while the state of close contact between the rubber sheet 27 and the matrix 28 is being maintained, a melt 31 of a low melting-point alloy is poured into the die casting frame 21 through the pouring port 25. The level of the melt 31 gradually rises from the bottom toward the top and, in the meantime, the air inside the die casting frame 21 is discharged to the outside through gaps between the base plate 23 and the side plates 24 in the upper portions thereof. Meanwhile, the air between the rubber sheet 27 and the matrix 28 moves upward through the gap therebetween and the air vent hole 30 and is discharged to the outside through the pouring port 26 on the punch casting frame 22 side. Thus, the melt 31 of the low melting-point alloy is poured, and pouring is completed by leaving an air chamber 32 marginally between the upper side plate 24 and the melt 31. In this state, the melt 31 is allowed to cool and solidify, thereby completing the casting operation of the die D.

In the above-described first step, an arrangement may be provided such that, upon completion of the pouring of the melt 31 of the low melting-point alloy, a pipe 33 is connected to the pouring port 25, and compressed air is supplied to the air chamber 32 so as to press the melt 31. This allows the rubber sheet 27 to be brought into close contact with the matrix 28 more positively.

Subsequently, the base plate 23 on the punch casting frame 22 side is removed, the matrix 28 placed inside is also removed, and the base plate 23 is then reinstalled, as shown in FIG. 4. During this operation, negative pressure is applied to the die casting frame 21 side by means of a vacuum pump (not shown) through the pouring port 25 on the die casting frame 21 side. This causes the air between the rubber sheet 27 and the die D to be exhausted, allowing the rubber sheet 27 to maintain its state of close contact with the die D. Subsequently, the melt of the low melting-point alloy is poured into the punch casting frame 22 through the pouring port 26 and, in this state, the melt 31 is allowed to cool and solidify, thereby obtaining the punch P. At this time, an arrangement may be provided such that, in the same manner as the above-described first step, a pipe 34 is connected to the pouring port 26 (see FIG. 4), and the melt 31 is pressed by supplying compressed air into the interior of the punch casting frame 22. This allows the rubber sheet 27 to be brought into close contact with the die D more positively.

In the above second embodiment, since the die molding frame 21 and the punch molding frame 22 are joined from the left side and the right side to make the product configuration surface 28*a* of the matrix 28 or the product configuration surface of a die D along the vertical plane, the air is easily exhausted upward in a casting process to avoid the occurrence of a defective casting by involving air therein.

Figure 5:
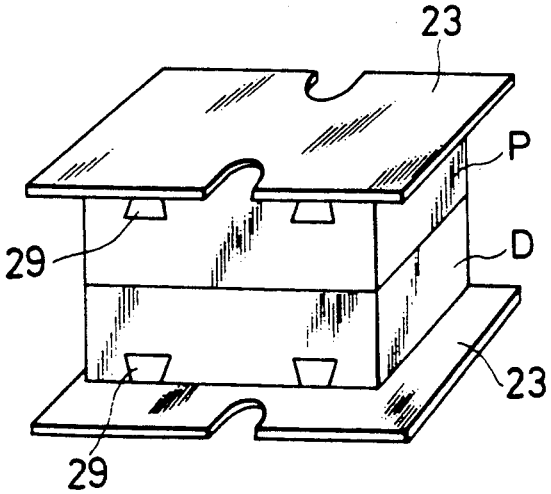
FIG. 5 is a perspective view of a metal mold obtained in the second embodiment.

After the casting of the punch P, the casting frames 21, 22 are separated from each other, the side plates 24 are removed from the casting frames 21, 22, and the rubber sheet 27 is also removed. Then, as shown in FIG. 5, a press die having the die D and the punch P respectively provided on the base plates 23 is completed. Since the die D and the punch P are securely connected to the respective base plates 23 by means of the pegs 29, it is possible to effect a stable stamping operation without any occurrence of rattling during use. Incidentally, the side plates 24 may not be removed and may be set on a stamping machine as they are as holding frames.

Further, as a modification from the above second embodiment, it is also possible to use the above die molding frame 21 and the punch molding frame 22 by joining them vertically. In this case, in order to make the air ventilation easier it is preferable first to cast the die D by pouring the melt of the low melting point alloy in the upper molding frame 21, subsequently to turn the die molding frame 21 and the punch molding frame 22 upside down, to remove the matrix 28 from the upper punch molding frame 22 and pour the melt to cast the punch P.

Figure 6:
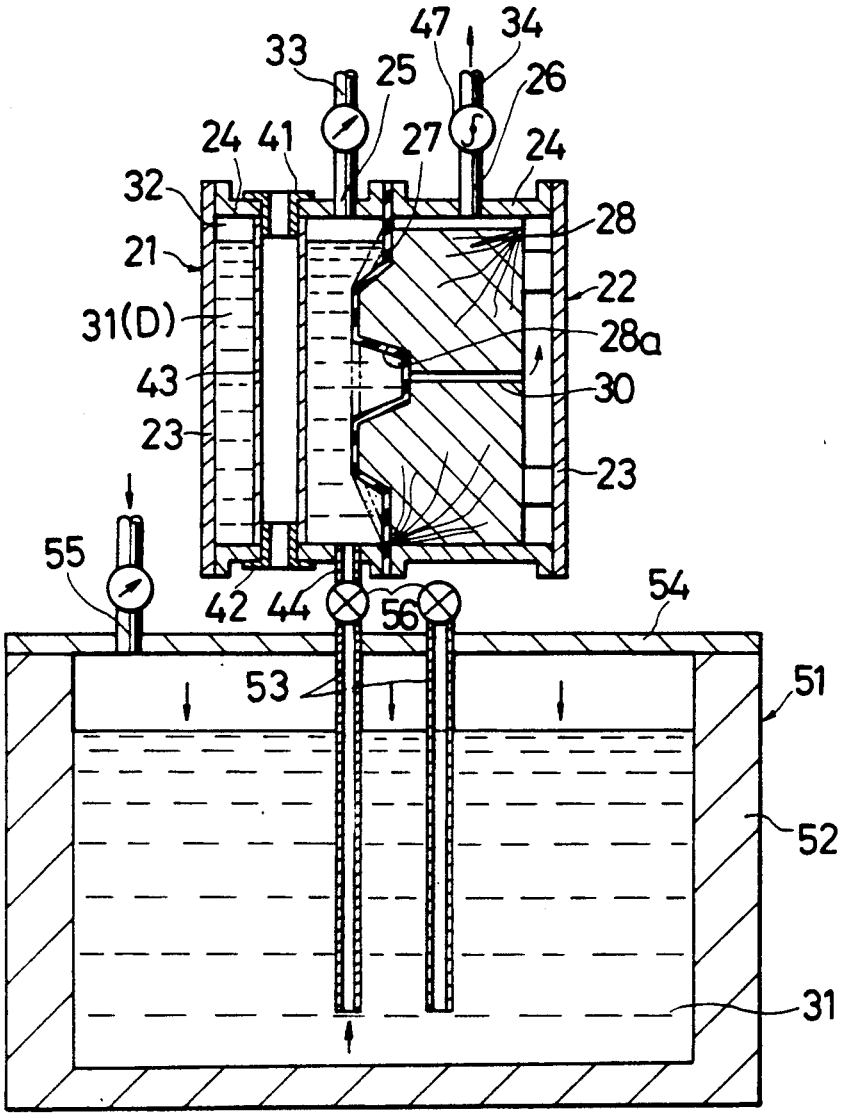
FIGS. 6 and 7 are cross-sectional views of a third embodiment of the present invention, illustrated in the order of steps.
Figure 7:
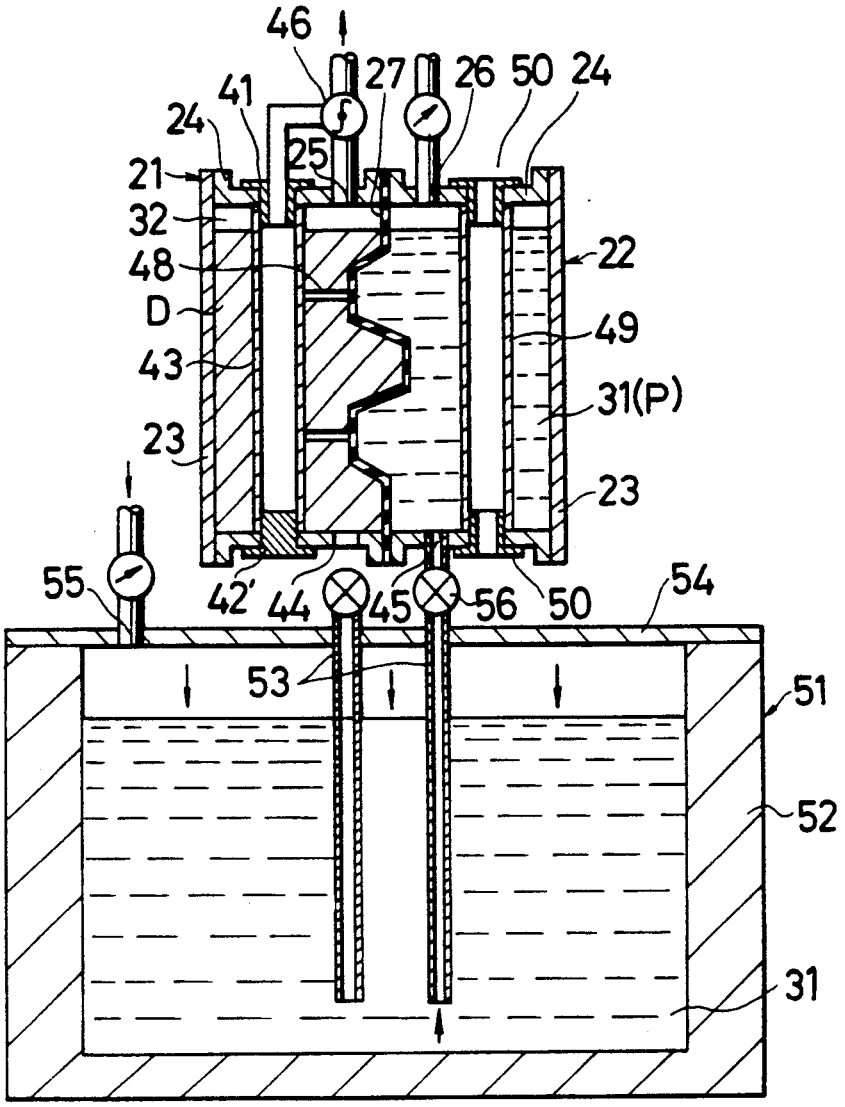

FIGS. 6 and 7 illustrate a third embodiment of the present invention, and its arrangement is identical with that of the above-described second embodiment, in that it mainly comprises a first step (see FIG. 6) for casting the die D and a second step (see FIG. 7) for casting the punch P. Components that are identical with those shown in FIGS. 3 and 4 are denoted by the same reference numerals, and a description thereof will be omitted. In this third embodiment, a pair of fixing members 41, 42 are provided respectively on the upper and lower side plates 24 of the die casting frame 21 in such a manner as to oppose each other vertically, so that opposite ends of a metal pipe 43 accommodated in the casting frame 21 can be supported and made watertight by the fixing members 41, 42. In addition, the lower side plates 24 of the casting frames 21, 22 are respectively provided with lower pouring ports 44, 45 separately from the aforementioned pouring ports 25, 26. An arrangement is provided such that vacuum pumps 46, 47 can be respectively provided in the aforementioned pipes 33, 34 that are connected to the pouring ports 25, 26 of the casting frames 21, 22, while the metal pipe 43 can be connected to the vacuum pump 46 on the die casting frame 21 side.

In the first step of the third embodiment, the metal pipe 43 is accommodated in advance in the die casting frame 21, and its ends are secured by the fixing members 41, 42. The matrix 28 is then accommodated in the punch casting frame 22. After the two casting frames 21, 22 are assembled as a unit with the rubber sheet 27 clamped therebetween, negative pressure is supplied to the punch casting frame 22 by the operation of the vacuum pump 47 on the punch casting frame 22 side, and causing the rubber sheet 27 to be brought into close contact with the product configuration surface 28*a* of the matrix 28. Then, as shown in FIG. 6, this assembly is positioned on a holding furnace 52 of a low-pressure casting apparatus 51. A stalk with its end portion immersed in the melt 31 of the low melting-point alloy inside the holding furnace 52 is connected to the lower pouring port 44 on the die casting frame 21 side. The holding furnace 52 is hermetically closed by a cover 54, and compressed air is supplied to the holding furnace 52 through an air supply port 55 provided in the cover 54. Then, the melt 31 is pushed upward inside the die casting frame 21 via the stalk 53. When the melt level has risen up to a point where the air chamber 32 remains marginally in the upper portion of the holding furnace 52, a valve 56 provided in the stalk 53 is closed. At the same time, compressed air is supplied from the pouring port 25 to the die casting frame 21 so as to press the melt 31, which, in turn, causes the rubber sheet 27 to be brought into close contact with the product configuration surface 28*a* of the matrix 28. In this state, the melt 31 is then allowed to solidify, thereby producing the die D with the metal pipe 43 inserted therein. It should be noted that the pressing of the melt 31 by compressed air through the pouring port 25 may be omitted.

Next, the die casting frame 21 and the punch casting frame 22 are separated from each other, the matrix 28 is removed from the punch casting frame 22, and the rubber sheet 27 is also removed. Then, air vent holes 48 are bored in the die D in such a manner as to extend horizontally, as viewed in FIG. 7, and communicate with the metal pipe 43. Subsequently, the casting frames 21, 22 are reinstalled with the rubber sheet 27 clamped therebetween, and negative pressure is supplied to the interiors of the die casting frame 21 and the metal pipe 43 by the operation of the vacuum pump 46 on the die casting frame 21 side (at this time, the lower fixing member 42 is replaced with a hermetic plug 42'), allowing the rubber sheet 27 to be brought into close contact with the punch-receiving surface of the die D. In addition, the stalk 53 is connected to the lower pouring port 45 on the punch casting frame 22 side, and the melt 31 of the low melting-point alloy in the holding furnace 52 is then pushed upward in the punch casting frame 22 in the same manner as the above-described first step and is allowed to solidify, thereby casting the punch P.

Figure 8:
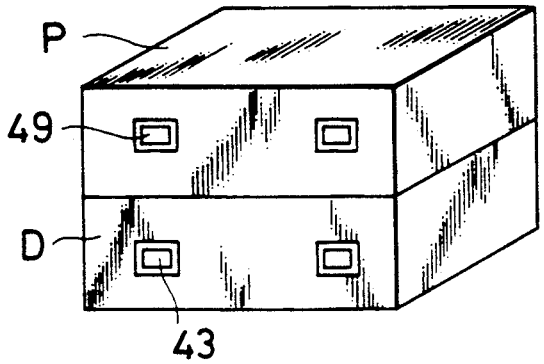
FIG. 8 is a perspective view of a metal mold obtained in the third embodiment.

In the second step of the above-described third embodiment, the melt 31 may be pushed by compressed air through the pouring port 26 on the punch casting frame 22 side so as to assist the close contact between the rubber sheet 27 and the die D. In addition, an arrangement may be provided such that, as shown in FIG. 7, a metal pipe 49 is accommodated in advance in the punch casting frame 22 and fixed by a pair of fixing members 50 provided on the side plates 24. In this case, as shown in FIG. 8, since the metal pipes 43, 49 are respectively inserted in the die D and punch P thus obtained, these metal pipes 43, 49 can be utilized in the setting of the die assembly on a stamping machine.

Figure 9:
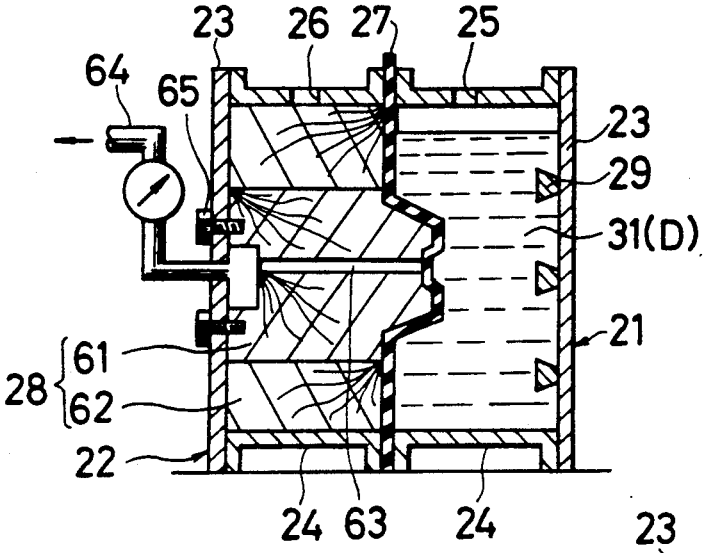
FIGS. 9, 10, 11 are cross-sectional views of a fourth embodiment of the present invention, illustrated in the order of steps.
Figure 10:
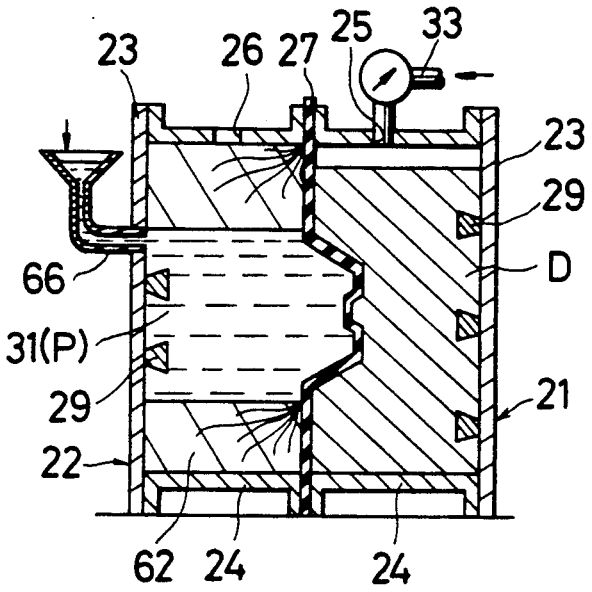
Figure 11:
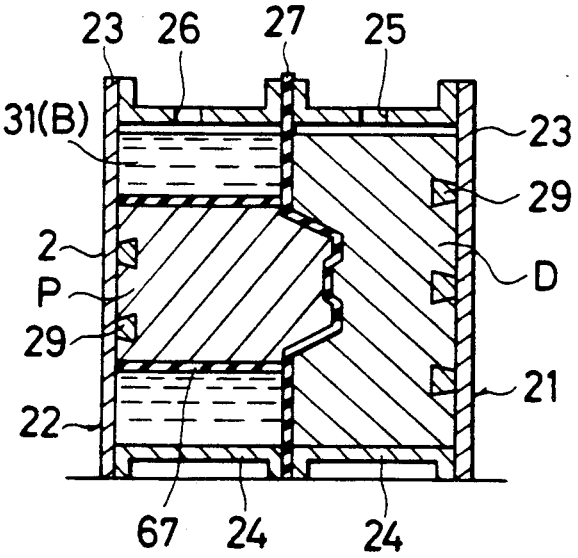

FIGS. 9 to 11 illustrate a fourth embodiment of the present invention. This fourth embodiment of the present invention mainly comprises a first step (see FIG. 9) for casting the die D, a second step (see FIG. 10) for casting the punch P, and a third step (see FIG. 11) for casting a blank holder B. Since the basic arrangement of the apparatus is identical with that of the above-described second embodiment, components that are identical with those shown in FIGS. 3 and 4 are denoted by the same reference numerals, and a description thereof will be omitted. In this fourth embodiment, the matrix 28 is arranged to be split into the two parts of a matrix 61 for a punch and a matrix 62 for a blank holder. First, as shown in FIG. 9, the matrix 61 for the punch and the matrix 62 for the blank holder are accommodated in the punch casting frame 22 together. The punch casting frame 22 is provided with a pipe 64 in correspondence with an air vent hole 63 provided in the matrix 61 for the punch, and a vacuum pump (not shown) is connected to the pipe 64. In addition, the matrix 61 for the punch is fixed to the punch casting frame 22 by means of bolts 65. After the die casting frame 21 and the punch casting frame 22 are arranged integrally with the rubber sheet 27 clamped therebetween, negative pressure is immediately introduced into the punch casting frame 22 via the pipe 64, thereby causing the rubber sheet 27 to be brought into close contact with the matrix 61 for the punch and the matrix 62 for the blank holder. While this state of close contact is being maintained, a predetermined amount of the melt 31 of the low melting-point alloy is poured into the die casting frame 21 through the pouring port 25 and, in this state, the melt 31 is allowed to cool and solidify, thereby casting the die D.

Then, as shown in FIG. 10, the base plate 23 of the punch casting frame 22 is removed, and the matrix 61 for the punch is removed from the punch casting frame 22. At this juncture, negative pressure is supplied to the interior of the die casting frame 21, allowing the rubber sheet 27 to be brought into close contact with the die D. Subsequently, after the base plate 23 is reinstalled, the melt 31 is poured into the punch casting frame 22 through a pouring pipe 66 provided in the base plate 23, and the melt 31 is filled into the space where the matrix 61 for the punch has been evacuated. Then, the melt is allowed to cool and solidify as it is, thereby producing the punch P.

Subsequently, as shown in FIG. 11, the base plate 23 of the punch casting frame 22 is removed, the matrix 62 for the blank holder is also removed from within the punch casting frame 22, and a second heat resistant rubber sheet 67 formed of, for instance, silicone rubber or fluororubber is attached to a side surface of the punch P by the use of a heat resistant adhesive. Then, the base plate 23 is reinstalled, the melt 31 is poured into the punch casting frame 22 and into the evacuated space of the matrix 62 for the blank holder through the pouring port 26 and, in this state, the melt 31 is allowed to cool and solidify, thereby casting the blank holder B.

Figure 12:
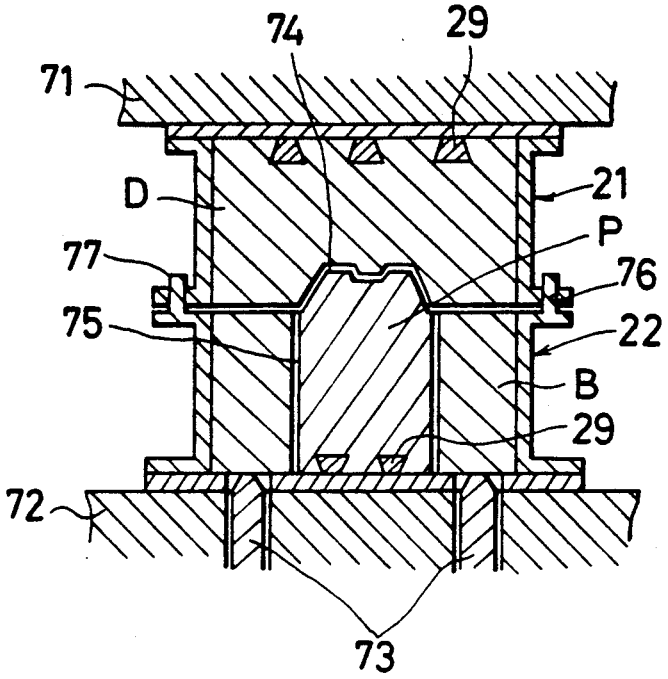
FIG. 12 is a cross-sectional view of a metal mold obtained in the fourth embodiment of the present invention, illustrating the form in which it is used.

The die D, punch P, and blank holder B obtained as described above are set on a stamping machine together with the die casting frame 21 and the punch casting frame 22, as shown in FIG. 12. In FIG. 12, reference numeral 71 denotes an upper ram; 72, a bolster; and 73, a cushion. The die D is secured on the upper ram 71 via the die casting frame 21, and the punch P is secured to the bolster 72 via the punch casting frame 22. Meanwhile, the blank holder B is supported by the cushions 73 extending through the base plate 23 of the punch casting frame 22. As such, predetermined clearances 74, 75 are respectively formed between the die D on the one hand and the punch P and the blank holder B on the other, as well as between the punch P and the blank holder B, thereby making it possible to perform a stamping operation effectively. At this juncture, if the die casting frame 21 is provided with guide holes 76, and the punch casting frame 22 is provided with guide pins 77, and the pins 77 are inserted into the respective holes 76, the die casting frame 21 and the punch casting frame 22 can be accurately positioned with respect to each other during a stamping operation, making it possible to enhance processing accuracy.

In the above-described fourth embodiment, the casting of the punch P is effected prior to the casting of the blank holder B, but the casting of the blank holder B may be effected before the casting of the punch P. In this case, the order of removing the matrix 61 for the punch and the matrix 62 for the blank holder is the reverse of the aforementioned order.

Further, as a modification from the fourth embodiment, it is possible to cast the punch P and the blank holder B simultaneously. In this case, it is cast in such a manner that the die molding frame 21 and the punch molding frame 22 are joined integrally in a vertical direction and first the die D is-cast by pouring the melt alloy of the lower melting point in the upper die molding frame 21 , then both of the above molding frames are turned upside down and the punch matrix 61 and the blank holder 62 are removed from the punch molding frame 22, and in the punch molding frame 22 a punch profile (instead of the rubber sheet 67 of FIG. 11) is disposed. Subsequently, by pouring in the punch molding frame 22, the punch P and the blank holder B are simultaneously cast. In this case, the above punch matrix and the blank holder may be formed integrally without being divided.

Figure 13:
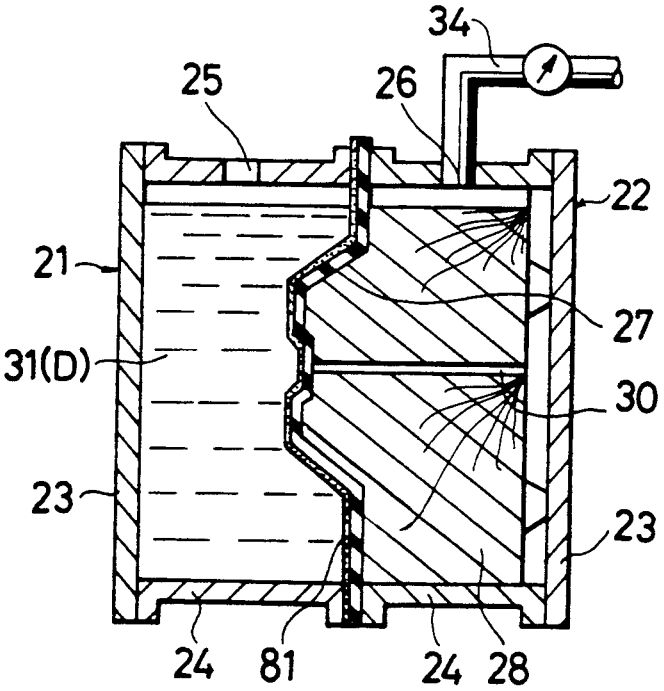
FIG. 13 is a cross-sectional view of a fifth embodiment of the present invention.

FIG. 13 illustrates a fifth embodiment of the present invention. A characteristic feature of this fifth embodiment lies in that, in a step corresponding to the first step of the above-described second embodiment, after the heat resistant rubber sheet 27 is brought into close contact with the matrix 28 by making use of negative pressure, an adhesive 81 comprising a thermosetting resin is applied to the surface of the rubber sheet 27. As a result of application of the adhesive 81 to the rubber sheet 27, the adhesive 81 hardens by the heat of the melt 31 of the low melting-point alloy poured into the die casting frame 21, and the rubber sheet 27 is bonded to the die D undergoing a solidifying process by means of the hardened adhesive, thereby maintaining the state of close contact between the rubber sheet 27 and the surface of the die D. Accordingly, through the second step (see FIG. 4) for casting the punch P, the rubber sheet 27 is prevented from floating above the die surface, and even if negative pressure is not introduced into the die casting frame 21, it is possible to obtain an excellent punch in terms of accuracy.

Figure 14:
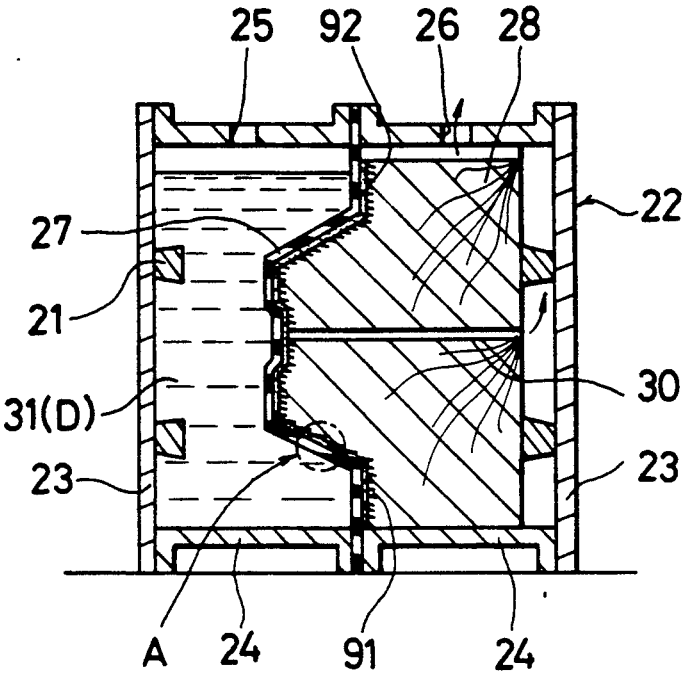
FIG. 14 is an enlarged cross-sectional view of a portion A shown in FIG. 13.
Figure 15:
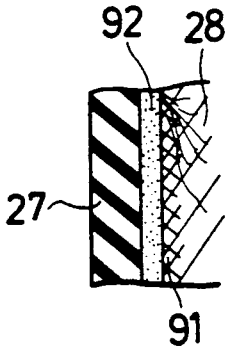
FIG. 15 is a cross-sectional view of a sixth embodiment of the present invention.

FIGS. 14 and 15 illustrate a sixth embodiment of the present invention. A characteristic feature of this sixth embodiment lies in that a silicone resin is sprayed in advance onto the surface of the matrix 28, and the silicone resin is allowed to sufficiently permeate the matrix 28 so as to form a silicone resin impregnated layer 91 on a surface layer portion of the matrix 28. Then, molybdenum disulfide ($MoS_2$), i.e., a substance having a low coefficient of friction, is sprayed onto the surface of the matrix 28 so as to form a film 92 of molybdenum disulfide on that surface. At this juncture, it is preferred that, after the spraying of molybdenum disulfide, the film 92 is slightly rubbed to improve its sliding characteristic. If this arrangement is adopted, when the rubber sheet 27 is brought into close contact with the matrix 28, since the frictional resistance between the rubber sheet 27 and the matrix 28 is reduced due to the presence of the film 92 of molybdenum disulfide, the rubber sheet 27 stretches or shrinks freely in the direction in which a difference in strain in the horizontal direction is overcome, with the result that the rubber sheet 27 is attached to the matrix 28 with a substantially fixed thickness corresponding to the thickness of a product to be stamped. It should be noted that a coefficient of friction $\mu$ between the rubber sheet 27 and the matrix 28 is 0.2 in a case where the film 92 of molybdenum disulfide is formed as in the case of this embodiment, whereas the coefficient of friction $\mu$ is 0.9 in a case where the film 92 is not provided. Thus it can be appreciated that this large difference in the coefficient of friction $\mu$ contributes to overcoming the aforementioned difference in strain. In addition, in this sixth embodiment, since the silicone resin impregnated layer 91 is formed underneath the film 92 of molybdenum disulfide, the effect of the surface roughness of the matrix 28 is minimized, which allows the rubber sheet 27 to stretch and shrink more smoothly, thereby making its thickness more uniform. By forming the silicone resin impregnated layer 91, it is possible to restrain generation of gas for the matrix 28, and in addition the harsh surface of the cast caused by the penetrating of the gas through the rubber sheet 27 is also restrained. Further, this silicone resin is replaceable with other heat resistant materials such as epoxy resin, fluorine resin or ceramics coating agent.

Accordingly, if the melt 31 of the low melting-point alloy is subsequently poured into the die casting frame 21 so as to be brought into contact with the matrix 28 and is allowed to cool and solidify in that state, it is possible to obtain the die D having a high degree of accuracy.

What is claimed is:

1. A method of producing a metal mold, comprising the steps of:

contacting by use of negative pressure a resilient rubber sheet with a product configuration surface of a matrix, said resilient rubber sheet having an even thickness corresponding to the plate thickness of a product, and having a heat resistance sufficient to maintain elasticity during subsequent processing, wherein during the contacting step said heat resistant and resilient rubber sheet stretches and shrinks freely;

contacting said heat resistant and resilient rubber sheet with a melt of a low melting-point alloy while maintaining close contact between said sheet and said matrix;

cooling said melt, thereby casting a first mold part;

removing said matrix;

contacting said heat resistant and resilient rubber sheet at said first mold part with said melt of a low melting-point alloy while maintaining contact between said sheet and said first mold part; and allowing said melt to cool, thereby casting a second mold part.

2. A method of producing a metal mold according to claim 1, wherein said heat resistant rubber sheet is formed of silicone rubber or fluororubber.

3. A method of producing a metal mold according to claim 1, wherein a heat resistant material is impregnated on the surface layer of the matrix.

4. A method of producing a metal mold according to claim 1, comprising the additional step of applying an adhesive comprising a thermosetting resin to a surface of said rubber sheet to be brought into said melt before said casting step.

5. A method of producing a metal mold according to claim 1, comprising the additional step of preparing a pair of casting frames, said matrix being accommodated in one of said casting frames, and said rubber sheet being clamped between said pair of casting frames.

6. A method of producing a metal mold according to claim 1 or 5, comprising the additional step of providing said matrix with an air vent hole, negative pressure being supplied through said air vent hole via said casting frame.

7. A method of producing a metal mold according to claim 1, wherein said first part of said mold is a die, and said second part of said mold is a punch.

8. A method of producing a metal mold according to claim 1, wherein negative pressure is used for bringing said rubber sheet into close contact with said first part of said mold after said casting step.

9. A method of producing a metal mold according to claim 1, further comprising the step of interposing a substance having a low coefficient of friction between said rubber sheet and the surface of said matrix prior to contacting said matrix and said rubber sheet with each other.

10. A method of producing a metal mold according to claim 9, wherein said substance having a low coefficient of friction is selected from molybdenum disulfide, boron nitride, and graphite.

11. The method according to claim 9, further comprising applying a coating resin to said product configuration surface of a matrix prior to bringing together said matrix, said substance having a low coefficient of friction and said heat resistant and resilient rubber sheet.

12. The method according to claim 11, wherein said coating resin is selected from a silicone resin, epoxy resin, fluorine resin or ceramic coating agent.

13. A method of producing a metal mold, comprising the steps of:

forming a casting space by integrally assembling a pair of frames;

dividing said casting space by means of a heat resistant and resilient rubber sheet having an even thickness corresponding to the plate thickness of a product, wherein said sheet is clamped between said pair of casting frames to form two casting chambers;

accommodating a matrix in one of said casting chambers;

pouring a melt of a low melting-point alloy into the other casting chamber and bringing together by use of negative pressure said heat resistant and resilient rubber sheet and said product configuration surface of said matrix, thereby casting a first part of a mold, wherein said sheet stretches and shrinks freely to maintain said even thickness between said casting chambers;

removing said matrix from said one casting chamber;

pouring said melt of a low melting-point alloy into said one casting chamber while maintaining close contact between said heat resistant and resilient rubber sheet and said first part of said mold, thereby casting a second part of said mold.

14. A method of producing a metal mold according to claim 13, wherein a pair of molding frames are assembled from the left side and right side, said matrix being accommodated in one frame to define a product configuration surface along the vertical plane.

15. A method of producing a metal mold according to claim 13, wherein a pair of molding frames are assembled vertically, one mold is cast by accommodating the matrix in the lower molding frame so as to direct the product configuration surface upward, and subsequently the pair of molding frames are turned upside down by 180 degree to cast the other molding frame.

16. A method of producing a metal mold according to claim 13, wherein said one molding frame is a die and the other molding frame is a punch.

17. The method according to claim 13, wherein a pouring step includes pouring the melt with a substance having a low coefficient of friction interposed between said heat resistant and resilient rubber sheet and the respective product configuration surface.

18. The method according to claim 17, further comprising applying a coating resin to said product configuration surface of a matrix prior to bringing together said matrix, said substance having a low coefficient of friction and said heat resistant and resilient rubber sheet.

19. The method according to claim 18, wherein said coating resin is selected from a silicone resin, epoxy resin, fluorine resin or ceramic coating agent.

20. A method of producing a metal mold, comprising the steps of:

forming a casting space by integrally assembling a die casting frame and a punch casting frame;

dividing said casting space into two parts by means of a heat resistant and resilient rubber sheet clamped between said casting frames, said sheet having an even thickness corresponding to the plate thickness of a product;

accommodating a matrix for a punch and a matrix for a blank holder inside said punch casting frame;

pouring a metal of a low melting-point alloy into said die casting frame and bringing together by use of negative pressure said heat resistant and resilient rubber sheet and one of said product configuration surfaces of one of said matrices, thereby casting a die, wherein said sheet stretches and shrinks freely to maintain said even thickness between said casting frames;

removing said one of said matrices from said punch casting frame;

pouring said melt of a low melting-point alloy into said punch casting frame with either one of said matrices removed while maintaining contact between said rubber sheet and said die, thereby casting either said punch or said blank holder;

removing the remaining one of said matrices; and pouring said melt of a low melting-point alloy into said punch casting frame with said remaining one of said matrices removed while maintaining contact between said rubber sheet and said die, thereby casting the other one of said punch and said blank holder.

21. A method of producing a metal mold according to claim 20, wherein said die casting frame and said punch casting frame are assembled from the left side and the right side, the matrix being accommodated in the punch casting frame to direct the product configuration surface along the vertical plane.

22. A method of producing a metal mold according to claim 20, wherein the die casting frame and the punch casting frame are assembled vertically, the die is cast by accommodating the matrix in the punch casting frame to direct the product configuration surface upward, and subsequently the die casting frame and the punch casting frame are turned upside down by 180 degree to cast the punch and the blank holder in turn.

23. The method according to claim 20, wherein a pouring step includes pouring the melt with a substance having a low coefficient of friction interposed between said heat resistant and resilient rubber sheet and the respective product configuration surface.

24. The method according to claim 23, further comprising applying a coating resin to said product configuration surface of a matrix prior to bringing together said matrix, said substance having a low coefficient of friction and said heat resistant and resilient rubber sheet.

25. The method according to claim 24, wherein said coating resin is selected from a silicone resin, epoxy resin, fluorine resin or ceramic coating agent.

26. A method of producing a metal mold, comprising the steps of:

forming a casting space by integrally assembling a die casting frame and a punch casting frame;

dividing said casting space into two parts by means of a heat resistant and resilient rubber sheet clamped between said casting frames, said sheet having an even thickness corresponding to the plate thickness of a product;

accommodating a matrix for a punch inside said punch casting frame;

casting the die by pouring a melt of a low melting-point alloy into said die casting frame while bringing together by use of negative pressure said heat resistant and resilient rubber sheet and said product configuration surfaces of said matrix, wherein said sheet stretches and shrinks freely to maintain said even thickness between said casting frames;

removing the matrix from the punch casting frames;

providing the punch profile formed of a steel sheet by imitating the contour of the punch and having plural holes in the punch; and subsequently pouring the melt of a low melting-point alloy into the punch casting frame with maintaining close contact between the rubber sheet and the die, thereby casting simultaneously the punch and the blank holder.

27. The method according to claim 26, wherein a pouring step includes pouring the metal with a substance having a low coefficient of friction interposed between said heat resistant and resilient rubber sheet and the respective product configuration surface.

28. The method according to claim 27, further comprising applying a coating resin to said product configuration surface of a matrix prior to bringing together said matrix, said substance having a low coefficient of friction and said heat resistant and resilient rubber sheet.

29. The method according to claim 28, wherein said coating resin is selected from a silicone resin, epoxy resin, fluorine resin or ceramic coating agent.

* * * * *